US011499209B2

(12) United States Patent
Kudo et al.

(10) Patent No.: US 11,499,209 B2
(45) Date of Patent: Nov. 15, 2022

(54) SUPERPLASTIC-FORMING ALUMINUM ALLOY PLATE AND PRODUCTION METHOD THEREFOR

(71) Applicant: UACJ Corporation, Tokyo (JP)

(72) Inventors: Tomoyuki Kudo, Tokyo (JP); Yoshifumi Shinzato, Tokyo (JP); Ryo Kuramoto, Tokyo (JP)

(73) Assignee: UACJ CORPORATION, Tokyo (JP)

( * ) Notice: Subject to any disclaimer, the term of this patent is extended or adjusted under 35 U.S.C. 154(b) by 464 days.

(21) Appl. No.: 15/517,518

(22) PCT Filed: Oct. 8, 2015

(86) PCT No.: PCT/JP2015/005121
§ 371 (c)(1),
(2) Date: Apr. 7, 2017

(87) PCT Pub. No.: WO2016/056240
PCT Pub. Date: Apr. 14, 2016

(65) Prior Publication Data

US 2017/0306453 A1 Oct. 26, 2017

(30) Foreign Application Priority Data

Oct. 9, 2014 (JP) ..... JP2014-208188

(51) Int. Cl.

| | |
|---|---|
| ***C22C 21/06*** | (2006.01) |
| ***B22D 11/00*** | (2006.01) |
| ***C22F 1/047*** | (2006.01) |
| ***C22C 21/00*** | (2006.01) |
| ***B22D 11/124*** | (2006.01) |
| ***B22D 11/049*** | (2006.01) |
| ***C22F 1/00*** | (2006.01) |
| ***C21D 8/02*** | (2006.01) |

(52) U.S. Cl.
CPC ..... *C22C 21/06* (2013.01); *B22D 11/00* (2013.01); *B22D 11/049* (2013.01); *B22D 11/124* (2013.01); *C22C 21/00* (2013.01); *C22F 1/047* (2013.01); *C21D 8/0226* (2013.01); *C21D 8/0236* (2013.01); *C22F 1/00* (2013.01)

(58) Field of Classification Search
CPC ..... B22D 11/00; B22D 11/049; B22D 11/124; C21D 8/0226; C21D 8/0236; C22C 21/00; C22C 21/06; C22F 1/00; C22F 1/047
USPC ..... 148/415
See application file for complete search history.

(56) References Cited

U.S. PATENT DOCUMENTS

| | | | | |
|---|---|---|---|---|
| 5,181,969 | A * | 1/1993 | Komatsubara | C22C 21/06 148/440 |
| 5,605,586 | A * | 2/1997 | Bekki | C22F 1/047 148/549 |
| 6,261,391 | B1 * | 7/2001 | Ikeda | C22C 21/06 148/440 |
| 2004/0074627 | A1 * | 4/2004 | Verma | C22C 21/06 164/476 |
| 2006/0035106 | A1 * | 2/2006 | Noguchi | C22C 21/08 428/650 |
| 2007/0217943 | A1 * | 9/2007 | Zhao | B22D 11/003 420/534 |
| 2008/0257462 | A1 * | 10/2008 | Ichitani | C22C 21/06 148/694 |
| 2011/0123391 | A1 * | 5/2011 | Kim | C22C 21/08 420/533 |

FOREIGN PATENT DOCUMENTS

| | | |
|---|---|---|
| EP | 0761837 | 3/1997 |
| EP | 3205734 A1 | 8/2017 |
| EP | 3205734 B1 | 12/2018 |
| JP | H04-218635 | 8/1992 |
| JP | H06-240395 | 8/1994 |
| JP | 2004-137601 | 5/2004 |
| JP | 2005-307300 | 11/2005 |
| JP | 2007-186747 | 7/2007 |
| JP | 2007186747 A * | 7/2007 |
| JP | 2009-197258 | 9/2009 |

(Continued)

OTHER PUBLICATIONS

Subodh K. Das, Modeling and Optimization of Direct Chill Casting to Reduce Ingot Cracking, Jun. 2006 (Year: 2006).*
Theo Mang and Kai F. Karhausen, Encyclopedia of Lubricants and Lubrication, published Jan. 2014 (Year: 2014).*
"International Search Report (Form PCT/ISA/210) of PCT/JP2015/005121", dated Dec. 15, 2015, with English translation thereof, pp. 1-4.
"Search Report of Europe Counterpart Application", dated Sep. 15, 2017, p. 1-p. 6.

(Continued)

*Primary Examiner* — Jie Yang
(74) *Attorney, Agent, or Firm* — JCIPRNET

(57) ABSTRACT

The present disclosure shows a superplastic-forming aluminum alloy plate that has excellent properties for superplastic-forming, such as blow forming, and that has excellent surface properties after forming. Shown is a superplastic-forming aluminum alloy plate and a production method therefor, the superplastic-forming aluminum alloy plate being characterized by comprising an aluminum alloy which contains 2.0 to 6.0 mass % Mg, 0.5 to 1.8 mass % Mn and 0.40 mass % or less Cr and in which the balance consists of Al and unavoidable impurities, wherein the unavoidable impurities are restricted to have 0.20 mass % or less Fe and 0.20 mass % or less Si, the 0.2% proof stress is 340 MPa or more, and the density of intermetallic compounds having an equivalent circular diameter of 5 to 15 μm at the RD-TD plane which extends along the center of the plate cross-section is 50 to 400 pieces/mm$^2$.

6 Claims, No Drawings

(56) References Cited

FOREIGN PATENT DOCUMENTS

| | | |
|---|---|---|
| JP | 2012224929 | 11/2012 |
| WO | 0140531 | 6/2001 |

OTHER PUBLICATIONS

Annex A3 of Opposition to European Pat. No. 3205734 "Feature analysis of claims 1 and 5" filed by Hydro Aluminum Rolled Products GMBH on Sep. 10, 2019, with partial English translation of relevant portion, pp. 1-4.
Annex A4 of Opposition to European Pat. No. 3205734 "Patentee's reply filed with the European Patent Office" dated Jan. 31, 2018, pp. 1-5.
Annex O1 of Opposition to European Pat. No. 3205734 "Order Metalweb" filed by Hydro Aluminum Rolled Products GMBH on Sep. 10, 2019, pp. 1-3.
Annex O2 of Opposition to European Pat. No. 3205734 "Order confirmation Hydro" filed by Hydro Aluminum Rolled Products GMBH on Sep. 10, 2019, pp. 1-2.
Annex O3 of Opposition to European Pat. No. 3205734 "Packing list Hydro to Decomecc(metal cutting plant)" filed by Hydro Aluminum Rolled Products GMBH on Sep. 10, 2019, with partial English translation of relevant portion, pp. 1-6.
Annex O4 of Opposition to European Pat. No. 3205734 "Cutting order Hydro to Decomecc" filed by Hydro Aluminum Rolled Products GMBH on Sep. 10, 2019, with partial English translation of relevant portion, pp. 1-6.
Annex O5 of Opposition to European Pat. No. 3205734 "Loading list Decomecc to Metalweb" filed by Hydro Aluminum Rolled Products GMBH on Sep. 10, 2019, with partial English translation of relevant portion, pp. 1-6.
Annex O6 of Opposition to European Pat. No. 3205734 "Packing list Hydro to Metalweb" filed by Hydro Aluminum Rolled Products GMBH on Sep. 10, 2019, pp. 1-2.
Annex O7 of Opposition to European Pat. No. 3205734 "Invoice Hydro to Metalweb" filed by Hydro Aluminum Rolled Products GMBH on Sep. 10, 2019, pp. 1-3.
Annex O8 of Opposition to European Pat. No. 3205734 "International consignment note" filed by Hydro Aluminum Rolled Products GMBH on Sep. 10, 2019, with partial English translation of relevant portion, pp. 1-5.
Annex O9 of Opposition to European Pat. No. 3205734 "Proof of receipt (Goods Received Note) Metalweb" filed by Hydro Aluminum Rolled Products GMBH on Sep. 10, 2019, pp. 1-7.
Annex O10 of Opposition to European Pat. No. 3205734 "Inspection Certificate" filed by Hydro Aluminum Rolled Products GMBH on Sep. 10, 2019, p. 1.
Annex O11 of Opposition to European Pat. No. 3205734 "Excerpt from Metalweb's homepage" filed by Hydro Aluminum Rolled Products GMBH on Sep. 10, 2019, pp. 1-3.
Annex O12 of Opposition to European Pat. No. 32050734 'Affidavit by Mr. Pritzlafr dated Apr. 9, 2019, with partial English translation of relevant portion, pp. 1-11.
Annex O13 of Opposition to European Pat. No. 3205734 "Order card and laboratory report of the wet-chemical analysis" dated Jun. 13, 2018, with partial English translation of relevant portion, pp. 1-12.
Annex O14 of Opposition to European Pat. No. 3205734 "Order card and laboratory report of metallography" dated Apr. 13, 2018, with partial English translation of relevant portion, pp. 1-8.
Annex O15 of Opposition to European Pat. No. 3205734 "Order card and laboratory report of mechanical analysis" dated Apr. 19, 2018, with partial English translation of relevant portion, pp. 1-8.
Annex O16 of Opposition to European Pat. No. 32050734 "Affidavit by Mr. Behrend" dated Aug. 21, 2019, with partial English translation of relevant portion, pp. 1-10.
Annex O17 of Opposition to European Pat. No. 32050734 'Affidavit by Mr. Pritzlafr dated Apr. 9, 2019, with partial English translation of relevant portion, pp. 1-17.
Annex E1 of Opposition to European Pat. No. 32050734, Mary-A. Kulas, et al., "Failure Mechanisms in Superplastic AA5083 Materials." Metallurgical and Materials Transactions, vol. 37A, No. 3, Mar. 2006, pp. 645-655, pp. 1-11.
Annex E2 of Opposition to European Pat. No. 32050734, Kulas, "Mechanical and Microstructural Characterization of Commercial AA5083 Aluminum Alloys." Doctor's dissertation, May 2004, The University of Texas at Austin, pp. 1-212.
Annex F1 of Opposition to European Pat. No. 3205734 "Excerpt from the book 'Aluminium Taschenbuch', 16th edition, vol. 1(2002)" filed by Hydro Aluminum Rolled Products GMBH on Sep. 10, 2019, with partial English translation of relevant portion, pp. 1-22.
Annex F2 of Opposition to European Pat. No. 3205734 "Excerpt from the book 'Aluminium Taschenbuch', 16th edition, vol. 2(2009)" filed by Hydro Aluminum Rolled Products GMBH on Sep. 10, 2019, with partial English translation of relevant portion, pp. 1-18.
Annex F3 of Opposition to European Pat. No. 3205734, R. E. Sanders Jr, et al., "Industrial Development of Non-Heat Treatable Aluminum Alloys." Proceedings of the 9th International Conference on Aluminium Alloys, Jan. 2004, pp. 53-64.
Annex F4 of Opposition to European Pat. No. 3205734, Masakazu Kobayashi, et al., "Preferential Growth of Cube-Oriented Grains in Partially Annealed and Additionally Rolled Aluminum Foils for Capacitors." Materials Transactions, vol. 45, No. 12, Sep. 2004, pp. 3247-3255.
Annex F5 of Opposition to European Pat. No. 3205734, Yoshimasa Takayama, et al., "Stored Energy and Taylor Factor Relation in an Al—Mg—Mn Alloy Sheet Worked by Continuous Cyclic Bending." Materials Transactions, vol. 45, No. 7, May 2004, pp. 2316-2325.
Annex F6 of Opposition to European Pat. No. 3205734 "GDA, Technical Bulletin W7 of the year 2007" filed by Hydro Aluminum Rolled Products GMBH on Sep. 10, 2019 with partial English translation of relevant portion, pp. 1-32.
Annex F6a of Opposition to European Pat. No. 3205734 "Extract from the homepage of the Gesamtverband der Aluminiumindustrie (GDA)" filed by Hydro Aluminum Rolled Products GMBH on Sep. 10, 2019, with partial English translation of relevant portion, pp. 1-2.
Annex G1 of Opposition to European Pat. No. 3205734 "Expert opinion by Prof. Dr.—Ing. habil Eckehard Specht" filed by Hydro Aluminum Rolled Products GMBH on Sep. 10, 2019, with partial English translation of relevant portion, pp. 1-14.
Annex E2a of Opposition to European Pat. No. 3205734 "Extract from the homepage of the University of Texas in Austin of Jun. 13, 2010 of web.archive.org" filed by Hydro Aluminum Rolled Products GMBH on Sep. 10, 2019, p. 1.
"Opposition to European Pat. No. 3205734", issued on Sep. 17, 2019, with English translation thereof, p. 1-p. 117.
"Office Action of Japan Counterpart Application", dated Oct. 1, 2020, with English translation thereof, p. 1-p. 7.
Evidence D40 of Summons to attend oral proceedings to European Pat. No. 3205734 "Declaration in lieu of an oath—Affidavit of Mr. Dave Goodard" filed by Hydro Aluminum Rolled Products GMBH on Sep. 21, 2020, pp. 1-7.
Evidence D41 of Summons to attend oral proceedings to European Pat. No. 3205734 "Documentation on the resale of sheet metal from Metalweb to Luxfer Superform" filed by Hydro Aluminum Rolled Products GMBH on Sep. 21, 2020, pp. 1-3.
"Summons to attend oral proceedings to European Pat. No. 3205734", issued on Jan. 11, 2021, p. 1-13.
"Reply to an examination report in opposition proceedings to European Pat. No. 3205734", with English translation thereof, filed on Sep. 21, 2020, p. 1-38.
"Office Action of Canada Counterpart Application," dated Feb. 16, 2022, p. 1-p. 4.
"Decision Revoking the European Patent No. 3205734", dated Nov. 15, 2021, pp. 1-18.
J.F. Grandfield et al., "DC Casting of Aluminium: Process Behaviour and Technology," Materials Forum, vol. 20, 1996, pp. 29-51.

(56) References Cited

OTHER PUBLICATIONS

R.Nadella et al., "Macrosegregation in direct-chill casting of aluminium alloys," Progress in Materials Science, Mar. 2008, pp. 1-135.
Bam, "Certificate of Analysis ERM®-EB307a," Certificate ERM®-EB307a, accepted on Sep. 2016, pp. 1-6.
"Letter from the Opponent of Europe Counterpart Application" with English translation thereof, dated Aug. 16, 2022, p. 1-p. 108.

* cited by examiner

SUPERPLASTIC-FORMING ALUMINUM ALLOY PLATE AND PRODUCTION METHOD THEREFOR

CROSS-REFERENCE TO RELATED APPLICATION

This application is a 371 application of the international PCT application serial no. PCT/JP2015/005121, filed on Oct. 8, 2015, which claims the priority benefit of Japan application no. 2014-208188, filed on Oct. 9, 2014. The entirety of each of the abovementioned patent applications is hereby incorporated by reference herein and made a part of this specification.

TECHNICAL FIELD

The present invention relates to a superplastic-forming aluminum alloy plate having excellent ductility at a high temperature, excellent surface properties after superplastic-forming and excellent corrosion resistance and to a production method thereof.

BACKGROUND ART

It is known that when an aluminum alloy having fine crystal grains is deformed at a high temperature of 300 to 500° C. and at a low strain rate, superplasticity is observed, and high ductility of 150% or more is obtained. In general, superplastic deformation occurs more easily when the crystal grains are fine, and high ductility is exhibited. One of typical forming methods using superplastic deformation is blow molding. Blow molding is a molding method in which a material to be formed is held in a heated mold and heated and then the material to be formed is formed into the shape of the mold by applying pressure with high-pressure gas. Blow molding enables integral forming of a complicated part, which is difficult to achieve by cold press forming.

Al—Mg-based (5000 series) aluminum alloys have excellent corrosion resistance and excellent weldability and have moderate strength even without aging heat treatment. Thus, Al—Mg-based aluminum alloys are widely used as general structural materials, and some Al—Mg-based aluminum alloys having excellent superplastic-forming characteristics have been also proposed (for example, PTLs 1 to 3). To obtain these Al—Mg-based aluminum alloys, the distributions of a fine Mn-based intermetallic compound and a precipitate which are effective in obtaining fine crystal grains are regulated, and the crystal grains of the entire materials are made fine to improve the ductility at a high temperature.

When a conventional Al—Mg-based aluminum alloy plate is superplastically formed, the formed article sometimes becomes uneven along the rolling direction. The unevenness is a problem in a part which requires excellent appearance, and the part cannot be used in some cases. Also, when the unevenness is reduced to a not remarkable degree by post-treatment, an additional step is required, resulting in an increase in the costs.

PTLs 1 to 3 only prevent a relatively large intermetallic compound and regulate a fine intermetallic compound or a precipitate to obtain fine crystal grains, but PTLs 1 to 3 do not mention the problem of the surface properties after forming. Therefore, the problem of the surface properties after forming could not be solved yet by the conventional techniques.

CITATION LIST

Patent Literature

PTL 1: JP-A-H4-218635
PTL 2: JP-A-2007-186747
PTL 3: JP-A-2005-307300

DISCLOSURE OF INVENTION

Technical Problem

The invention solves the problem of the conventional superplastic-forming aluminum alloy plate and to provide a superplastic-forming aluminum alloy plate having excellent ductility at a high temperature, excellent surface properties after superplastic-forming and excellent corrosion resistance and a production method thereof.

Solution to Problem

To solve the problem, the present inventors have extensively investigated the relation between the texture of a cold-rolled plate before superplastic-forming such as blow molding and the superplastic-forming properties and the surface properties. As a result, the inventors have found that a relatively large intermetallic compound at the RD-TD plane which extends along the center of the cold-rolled plate cross-section changes the texture after recrystallization and improves the surface properties after superplastic-forming. In addition, the inventors have found that the surface properties after forming can be further improved by reducing the recovery region in which the strain is smaller than in the surrounding region at the RD-TD plane which extends along the center of the cold-rolled plate cross-section. Based on the findings, the inventors have found that an aluminum cold-rolled plate for superplastic-forming which can have both surface properties after forming and superplastic-forming properties is obtained by regulating the distribution of a relatively large intermetallic compound and the strain distribution at the RD-TD plane which extends along the center of the cold-rolled plate cross-section before recrystallization, and the inventors have also found a production method to obtain these characteristics. The invention has been thus completed. Here, the RD-TD plane refers to the plane formed by the rolling direction (RD) and the direction orthogonal to the rolling direction along the rolling plane (TD).

Namely, in claim 1, the invention is directed to a superplastic-forming aluminum alloy plate comprising an aluminum alloy containing 2.0 to 6.0 mass % Mg, 0.5 to 1.8 mass % Mn, 0.40 mass % or less Cr and a balance of Al and unavoidable impurities, wherein the unavoidable impurities are restricted to have 0.20 mass % or less Fe and 0.20 mass % or less Si, the 0.2% proof stress is 340 MPa or more and the density of intermetallic compounds having an equivalent circle diameter of 5 to 15 μm at the RD-TD plane which extends along the center of the plate cross-section is 50 to 400 pieces/$mm^2$.

In claim 2 of the invention, the unavoidable impurities are further restricted to have at least one selected from 0.05 mass % or less Cu and 0.05 mass % or less Zn, in claim 1.

In claim 3 of the invention, a crystal grain size after superplastic-forming at the RD-TD plane which extends along the center of the plate cross-section is 10 μm or less, in claim 1 or 2.

In claim 4 of the invention, a frequency of Kernel Average Misorientation of 15° or less at the RD-TD plane which extends along the center of the plate cross-section is 0.34 or less, in any one of claims 1 to 3.

In claim 5 of the invention, the aluminum alloy plate is used for blow molding, in any one of claims 1 to 4.

In claim 6, the invention is directed to a method for producing the superplastic-forming aluminum alloy plate according to any one of claims 1 to 5, comprising:

a casting step for casting a molten metal of the aluminum alloy in which $1000 \leq t/L \leq 4000$ is satisfied, where t is the thickness of an ingot (mm) and L is an amount of cooling water per unit time and unit ingot length (liter/minute·mm), a homogenization step for heat treating the obtained ingot at 400 to 560° C. for 0.5 hours or longer, a hot rolling step for hot rolling the homogenized ingot in which the reduction ratio at a temperature of 250 to 350° C. in the last 1 pass is 30% or more, and a cold rolling step for cold rolling the hot-rolled plate with a final reduction ratio in cold rolling of 50% or more.

In claim 7 of the invention, the method for producing the superplastic-forming aluminum alloy plate further comprises one or, two or more process annealing steps for annealing the rolled plate at 300 to 400° C. for one to four hours before or during the cold rolling step or before and during the cold rolling step, in claim 6.

Advantageous Effects of Invention

According to the invention, a superplastic-forming aluminum alloy plate having excellent properties for superplastic-forming such as blow molding, excellent surface properties after forming and excellent corrosion resistance can be provided.

DESCRIPTION OF EMBODIMENTS

The superplastic-forming aluminum alloy plate according to the invention has a predetermined alloy composition and has predetermined proof stress and an intermetallic compound density. The application for superplastic-forming can be for blow molding, hot pressing or the like, but the effects are high when the invention is applied to blow molding, in which the properties of the surface which does not touch the mold are an issue. The invention is explained in detail below.

1. Metallic Texture

First, it is essential to introduce large strain by cold rolling in order to obtain fine crystal grains for superplastic-forming such as blow molding to obtain ductility at a high temperature. By introducing large strain, a strong deformation zone is formed and results in sites for the nucleation of recrystallized grains formed by heating during blow molding. The amount of strain introduced during cold rolling can be estimated by the 0.2% proof stress of the cold-rolled plate. To obtain sufficient superplastic characteristics, it is necessary that the 0.2% proof stress is 340 MPa or more, and the 0.2% proof stress is preferably 380 MPa or more. The upper limit of the 0.2% proof stress is not particularly limited but is preferably 460 MPa in the invention. Here, increasing the reduction ratio in cold rolling is effective in accumulating strain in the material and increasing the 0.2% proof stress.

Next, it is important to degrade the texture formed by hot rolling to prevent the surface quality from deteriorating after blow molding. In particular, the texture in the center of a cross section of the cold-rolled plate of the aluminum alloy greatly affects the surface quality. Here, a relatively large intermetallic compound which is formed in the material and which has an equivalent circle diameter of 5 to 15 μm tends to become a site for the nucleation of recrystallization in an orientation different from that of the hot-rolled texture and is effective in degrading the hot-rolled texture. That is, accumulating large strain in the entire material and at the same time forming a large amount of an intermetallic compound having an equivalent circle diameter (diameter of the equivalent circle) of 5 to 15 μm in the center of a cross section of the cold-rolled plate of the aluminum alloy, specifically at the RD-TD plane which extends along the center of the plate cross-section (the center of the plate thickness), are effective in preventing the deterioration of the surface quality. In this regard, an intermetallic compound of less than 5 μm is excluded because the tendency to become a site for the nucleation of recrystallization in an orientation different from that of the hot-rolled texture is slight. An intermetallic compound of more than 15 μm becomes a site from which a deficiency of cavity is formed during forming and deteriorates the formability, and thus the intermetallic compound is also excluded. The intermetallic compounds are mainly Al—Mn-based intermetallic compounds.

When the density of an intermetallic compound having an equivalent circle diameter of 5 to 15 μm is less than 50 pieces/mm$^2$ at the RD-TD plane which extends along the center of the plate cross-section, a high effect of improving the surface quality is not obtained. On the other hand, when the density exceeds 400 pieces/mm$^2$ or more, the intermetallic compound becomes a site from which cavitation occurs, resulting in the deterioration of the formability. Therefore, in the invention, the density of an intermetallic compound having an equivalent circle diameter of 5 to 15 μm at the RD-TD plane which extends along the center of the plate cross-section is specified to be 50 to 400 pieces/mm$^2$. The density is preferably 200 to 400 pieces/mm$^2$. In this regard, the density of the intermetallic compound is measured with an image analyzer attached to an optical microscope.

The ductility at a high temperature can be improved by regulating the crystal grain size after superplastic-forming at the RD-TD plane which extends along the center of the plate cross-section to 10 μm or less. The crystal grain size is measured by cutting out the RD-TD plane which extends along the center of the plate cross-section from a sample and measuring using a crystal orientation analyzer attached to a scanning electron microscope. The measurement step was 1 μm, and when the difference in angle between neighboring orientations was 15° or more, the boundary of the neighboring orientations was considered as a crystal grain boundary. The crystal grain size is preferably 7 μm or less.

The surface quality can be further improved by reducing the region in which the amount of strain is smaller than in the surrounding region (recovery region) at the RD-TD plane which extends along the center of the plate cross-section. The distribution of strain introduced to the material can be estimated by the frequency distribution of Kernel Average Misorientation (hereinafter referred to as "KAM") measured by EBSP (Electron Backscatter Diffraction Pattern). KAM gives the angle of inclination of local grain boundaries. A region in which grain boundaries of KAM of larger than 15° are distributed highly densely indicates that a large amount of strain has been introduced, while a region in which grain boundaries of KAM of 15° or less are distributed highly densely indicates a region in which the recovery is advanced and the amount of strain introduced is small. Thus, to further improve the surface quality after forming, the frequency of KAM of 15° or less is preferably 0.34 or less, further preferably 0.25 or less, at the RD-TD plane which extends along the center of the plate cross-section. The lower limit of the frequency is not particularly limited but is most preferably 0. Here, the KAM is measured by cutting out the RD-TD plane which extends along the cross-section from a sample and measuring using a crystal orientation analyzer attached to a scanning electron microscope. In the invention, the frequency of KAM of 15° or less is defined as the sum of the frequencies of the KAM values of 0° to 15° of the frequency distribution of KAM. The measurement step is 1 μm.

2. Composition of Aluminum Alloy

Next, the composition of the superplastic-forming aluminum alloy plate of the invention and the reasons for the limitations are shown below.

2-1. Mg: 2.0 to 6.0 Mass %

Mg promotes the accumulation of strain after cold rolling and is effective in making the crystal grains fine because Mg stabilizes the boundaries of the recrystallized grains at a high temperature. When the Mg content is less than 2.0 mass % (hereinafter simply referred to as "%"), it is difficult to make the crystal grains fine, while when the Mg content exceeds 6.0%, the hot ductility and the cold ductility decrease, and the productivity is poor. Accordingly, the Mg content is specified to be 2.0 to 6.0%. A preferable Mg content is 4.0 to 5.0%.

2-2. Mn: 0.5 to 1.8%

When Mn is added, a relatively large Al—Mn-based intermetallic compound and a fine precipitate are formed. An Al—Mn-based intermetallic compound having an equivalent circle diameter of 5 to 15 μm becomes a site for the nucleation of a recrystallized grain, and a fine Al—Mn-based precipitate has a function of preventing the growth of the recrystallized grains. Accordingly, addition of Mn is effective in improving the surface quality and making the recrystallized grains fine. When the Mn content is less than 0.5%, the effect of making the crystal grains fine is not sufficient, and the Al—Mn-based intermetallic compound having an equivalent circle diameter of 5 to 15 μm cannot be dispersed highly densely. On the other hand, when the Mn content exceeds 1.8%, an extremely coarse, for example of an equivalent circle diameter of more than 20 μm, Al—Mn-based intermetallic compound is formed, and the formability is deteriorated considerably. Accordingly, the Mn amount is specified to be 0.5 to 1.8%. A preferable Mn content is 0.7 to 1.5%.

2-3. Cr: 0.40% or Less

When Cr is added, a relatively large Al—Cr-based intermetallic compound and a fine precipitate are formed. An Al—Cr-based intermetallic compound having an equivalent circle diameter of 5 to 15 μm becomes a site for the nucleation of a recrystallized grain, and a fine Al—Cr-based precipitate has a function of preventing the growth of the recrystallized grains. Accordingly, as Mn, addition of Cr is effective in improving the surface quality and making the recrystallized grains fine. When the Cr content exceeds 0.4%, an extremely coarse, for example of an equivalent circle diameter of more than 20 μm, Al—Cr intermetallic compound is formed, and the formability is deteriorated considerably. Therefore, the Cr content is restricted to be 0.4% or less, preferably 0.1% or less. The Cr content may be 0%.

2-4. Fe: 0.20% or Less

A general aluminum alloy may contain Fe, Si, Cu, Zn and Ti as unavoidable impurities. When the Fe content is high, a coarse (for example of an equivalent circle diameter of more than 20 μm) Al—Mn—Fe-based intermetallic compound is apt to be formed and becomes a site from which cavitation occurs, resulting in the deterioration of the formability. Thus, the Fe content is restricted to be 0.20% or less, preferably 0.10% or less. The Fe content may be 0%.

2-5. Si: 0.20% or Less

When the Si content is high, a coarse (for example of an equivalent circle diameter of more than 20 μm) $Mg_2Si$-based intermetallic compound is apt to be formed and becomes a site from which cavitation occurs, resulting in the deterioration of the formability. Thus, the Si content is restricted to be 0.20% or less, preferably 0.10% or less. The Si content may be 0%.

2-6. Cu: 0.05% or Less

The strength can be improved when Cu is contained, and Cu may be thus contained. However, the corrosion resistance is impaired when Cu is contained. Thus, the Cu content is restricted to be 0.05% or less. The Cu content may be 0%.

2-7. Zn: 0.05% or Less

The strength can be increased when Zn is contained, and Zn may be thus contained. However, the corrosion resistance is impaired when Zn is contained. Thus, the Zn content is restricted to be 0.05% or less. The Zn content may be 0%.

2-8. Ti: 0.10% or Less

The ingot texture can be made fine when Ti is contained, and Ti may be thus contained. However, when Ti is contained, this leads to the formation of a coarse intermetallic compound, and the formability deteriorates. Thus, the Ti content is preferably restricted to be 0.10% or less. The Ti content may be 0%.

2-9. Other Unavoidable Impurities

Zr, B, Be and the like may be contained as other unavoidable impurities each in an amount of 0.05% or less and in a total amount of 0.15% or less.

3. Production Method

Next, the method for producing a superplastic-forming aluminum alloy plate of the invention is explained.

3-1. Casting Step

First, a molten alloy metal having the alloy composition is produced and cast. The casting process of the casting step is preferably the semi-continuous casting process (DC casting). Because the cooling rate of the center of a cross section of the slab (ingot) can be regulated by the ingot thickness and the amount of cooling water in DC casting, the density of an intermetallic compound of 5 to 15 μm in the center of a cross section of the final plate can be regulated. In the invention, the indicator of the cooling rate represented by t/L is $1000 \leq t/L \leq 4000$, preferably $3000 \leq t/L \leq 4000$, where t is the thickness of the ingot produced (mm) and L is the amount of cooling water per unit time and per unit length of ingot thickness (unit ingot length) (liter/minute·mm). In the case of $t/L < 1000$, the intermetallic compound having an equivalent circle diameter of 5 to 15 μm is difficult to form, and the case is not effective in improving the surface properties after forming. On the other hand, in the case of $t/L > 4000$, the intermetallic compound having an equivalent circle diameter of 5 to 15 μm becomes a site from which cavitation occurs, and the generated cavitations are connected and deteriorate the formability. In this regard, the larger the t/L value is, the lower the cooling rate is, while the smaller the t/L value is, the higher the cooling rate is.

3-2. Homogenization Step

The ingot obtained by the DC casting process is subjected to a homogenization step after facing the ingot if necessary. The conditions of the homogenization are at 400 to 560° C. for 0.5 hours or longer, preferably at 500 to 560° C. for 0.5 hours or longer. When the treatment temperature is lower than 400° C., the homogenization is insufficient, while when the treatment temperature exceeds 560° C., a eutectic melting occurs, and the formability deteriorates. When the treatment period is shorter than 0.5 hours, the homogenization is insufficient. The upper limit of the treatment period is not particularly limited, but the effect of the homogenization is saturated when the treatment period exceeds 12 hours, and the treatment is uneconomical. Accordingly, the upper limit is preferably 12 hours. The homogenization may serve also as preliminary heating before hot rolling in the following step or may be conducted separately from preliminary heating before hot rolling.

3-3. Hot Rolling Step

The ingot is subjected to a hot rolling step after the homogenization step. The hot rolling step includes a preliminary heating stage before rolling. The last 1 pass of hot rolling affects the surface properties after forming. Thus, in the last 1 pass of hot rolling, the reduction ratio in a temperature range which is not higher than the recrystallization temperature and in which the deformation resistance of the material is small, namely at a temperature of 250° C. to 350° C., is preferably 30% or more. This results in the uniform introduction of strain into the center of the plate thickness. When the hot rolling temperature is lower than 250° C., the deformation resistance becomes large, and hot rolling becomes difficult. On the other hand, when the hot rolling temperature exceeds 350° C., a wide region with small strain is generated. Also, when the reduction ratio is less than 30%, a wide region with small strain is generated as well. The upper limit of the reduction ratio is not particularly limited but is preferably 50% in the invention, more preferably 40%. By setting the hot rolling step in this manner, the recovery region in which the amount of strain is smaller than in the surrounding region can be reduced also in the final plate, and thus the surface properties after forming is improved.

3-4. Cold Rolling Step

The rolled plate is subjected to a cold rolling step to obtain a desired final thickness after the hot rolling step. To introduce large strain to the entire material and make the recrystallized grains fine, the final reduction ratio in cold rolling is 50% or more, preferably 70% or more, in the cold rolling step. The upper limit of the final reduction ratio in cold rolling is not particularly limited but is preferably 90%, more preferably 80%. The final reduction ratio in cold rolling means the reduction ratio in cold rolling calculated from the thickness after hot rolling and the thickness after cold rolling. When the process annealing described below is conducted once, twice or more, the final reduction ratio in cold rolling means the reduction ratio in cold rolling calculated from the thickness after final process annealing and the thickness after cold rolling.

3-5. Process Annealing Step

Furthermore, process annealing may be conducted once, twice or more before cold rolling, during cold rolling or before and during cold rolling. The conditions of process annealing are preferably at 300 to 400° C. for one to four hours. By process annealing, an effect of improving the surface properties after forming is obtained.

EXAMPLES

First Example

First, the first Example of the invention is explained. Ingots of alloys having the compositions shown in Table 1 were produced by the DC casting process. As shown in Table 2, the distributions of an intermetallic compound of 5 to 15 μm formed in the centers of cross sections of the plates were adjusted by regulating the t/L values in the casting step. The ingots having the alloy compositions were subjected to facing and then to the homogenization shown in Table 2. Next, after heating the ingots at 500° C. for 180 minutes, the ingots were hot rolled. As shown in Table 2, the reduction ratios at 250° C. to 350° C. were regulated in the last 1 pass of hot rolling, and the strain distributions in the centers of cross sections of the final plates were adjusted. Final plate samples having a thickness of 1 mm were obtained by cold rolling the plates at various reduction ratios in cold rolling after the hot step. When the materials were subjected to process annealing, process annealing was conducted using an atmosphere furnace under holding conditions at 360° C. for two hours.

TABLE 1

| Alloy | Alloy Composition (mass %) | | | | | | |
|---|---|---|---|---|---|---|---|
| Number | Mg | Mn | Cr | Fe | Si | Al | Remarks |
| A1 | 4.5 | 0.7 | 0.05 | 0.05 | 0.03 | balance | within the scope of the invention |
| A2 | 2.2 | 0.7 | 0.05 | 0.05 | 0.03 | balance | within the scope of the invention |
| A3 | 5.8 | 0.7 | 0.05 | 0.05 | 0.03 | balance | within the scope of the invention |
| A4 | 1.5 | 0.7 | 0.05 | 0.05 | 0.03 | balance | outside the scope of the invention |
| A5 | 6.5 | 0.7 | 0.05 | 0.05 | 0.03 | balance | outside the scope of the invention |
| A6 | 4.5 | 0.6 | 0.05 | 0.05 | 0.03 | balance | within the scope of the invention |
| A7 | 4.5 | 0.4 | 0.05 | 0.05 | 0.03 | balance | outside the scope of the invention |
| A8 | 4.5 | 1.7 | 0.05 | 0.05 | 0.03 | balance | within the scope of the invention |
| A9 | 4.5 | 1.9 | 0.05 | 0.05 | 0.03 | balance | outside the scope of the invention |
| A10 | 4.5 | 0.7 | 0.30 | 0.05 | 0.03 | balance | within the scope of the invention |
| A11 | 4.5 | 0.7 | 0.50 | 0.05 | 0.03 | balance | outside the scope of the invention |
| A12 | 4.5 | 0.7 | 0.05 | 0.15 | 0.03 | balance | within the scope of the invention |
| A13 | 4.5 | 0.7 | 0.05 | 0.30 | 0.03 | balance | outside the scope of the invention |
| A14 | 4.5 | 0.7 | 0.05 | 0.15 | 0.15 | balance | within the scope of the invention |
| A15 | 4.5 | 0.7 | 0.05 | 0.15 | 0.25 | balance | outside the scope of the invention |
| A16 | 4.5 | 1.7 | 0.001 | 0.05 | 0.03 | balance | within the scope of the invention |

TABLE 2

| Conditions of Production | Temperature of Homogenization (° C.) | Period of Homogenization (hr) | t/L ($mm^2$ · minute/liter) | Reduction Ratio in Hot Rolling at 250-350° C. in Last 1 Pass (%) | Process Annealing | Final Reduction Ratio in Cold Rolling (%) |
|---|---|---|---|---|---|---|
| P1 | 530 | 8 | 2000 | 40 | not conducted | 75 |
| P2 | 530 | 8 | 2000 | 50 | not conducted | 75 |
| P3 | 530 | 8 | 2000 | 15 | not conducted | 75 |
| P4 | 530 | 8 | 400 | 40 | not conducted | 75 |
| P5 | 530 | 8 | 3000 | 40 | not conducted | 75 |
| P6 | 530 | 8 | 5000 | 40 | not conducted | 75 |
| P7 | 390 | 8 | 2000 | 40 | not conducted | 75 |
| P8 | 450 | 8 | 2000 | 40 | not conducted | 75 |
| P9 | 570 | 8 | 2000 | 40 | not conducted | 75 |
| P10 | 530 | 0.3 | 2000 | 40 | not conducted | 75 |
| P11 | 530 | 11 | 2000 | 40 | not conducted | 75 |
| P12 | 530 | 13 | 2000 | 40 | not conducted | 75 |
| P13 | 530 | 8 | 2000 | 40 | not conducted | 55 |
| P14 | 530 | 8 | 2000 | 40 | not conducted | 40 |
| P15 | 530 | 8 | 2000 | 40 | not conducted | 80 |
| P16 | 530 | 8 | 2000 | 40 | not conducted | 90 |
| P17 | 530 | 8 | 2000 | 40 | conducted | 75 |

4. Evaluation of Samples 4-1. 0.2% Proof Stress

Three tensile test pieces having a length of 3 cm and a width of 20 cm were produced from the final plate sample. The width direction (the longitudinal direction) of the test piece was the rolling direction of the sample. The 0.2% proof stress of each produced test piece in the width direction was measured. The 0.2% proof stress was determined from the arithmetic mean of the values of the test pieces.

4-2. Density of Intermetallic Compound

A final plate sample was polished mechanically, and the RD-TD plane which extends along the center of the plate cross-section was exposed. Next, the exposed surface was mirror polished. Twenty-two random points of a measurement area of 0.2 $\mu m^2$ were selected from the polished surface, and the densities of an intermetallic compound having an equivalent circle diameter of 5 to 15 μm were measured at the measurement points using an image analyzer "LUZEX FS" manufactured by NIRECO Corporation. The density of the intermetallic compound was determined from the arithmetic mean of the values at the measurement points. The measurement step was 1 μm.

4-3. Frequency Distribution of KAM

Using a crystal orientation analyzer (MSC-2200 manufactured by TSL) attached to a scanning electron microscope (JSM-6510 manufactured by JEOL Ltd.), the frequency distributions of KAM were measured at the points for the measurement of the densities of the intermetallic compound, and the frequencies of KAM of 15° or less were measured. The frequency of KAM of 15° or less was determined from the arithmetic mean of the values at the measurement points. As in the measurement of the densities of the intermetallic compound, the measurement step was 1 μm.

4-4. Characteristics at High Temperature

After heating a final plate sample at 500° C. for 10 minutes, three tensile test pieces having a length of 1.5 cm and a width of 5.0 cm were produced. The width direction (the longitudinal direction) of the test piece was the rolling direction of the sample. The test pieces were subjected to a tensile test at a temperature of 500° C. at a strain rate of $10^{-3}$/second. The high-temperature tensile test was conducted up to the elongation of 25% and up to the breakage. The elongation at break (the ductility at a high temperature) was measured by the tensile test up to the breakage. The ductility at a high temperature was determined from the arithmetic mean of the values of the test pieces. The samples with ductility at a high temperature of 250% or more were determined to be acceptable, and the samples with ductility at a high temperature of less than 250% were determined to be unacceptable.

In addition, the surface properties of the test pieces after the tensile test up to the elongation of 25% were observed. A sample was determined to be excellent (A) when roughness of the surface was not observed visually in any of the test pieces, good (B) when slight roughness of the surface was observed in any of the test pieces and poor (D) when the roughness of the surface was clearly observed visually in any of the test pieces. The samples of A and B were determined to be acceptable.

The results of the evaluation are shown in Table 3.

TABLE 3

| | Alloy Number | Conditions of Production | 0.2% Proof Stress (MPa) | Density of Intermetallic Compound Having Equivalent Circle Diameter of 5-15 μm (pieces/$mm^2$ | Frequency of KAM ≤ 15° | Characteristics at High Temperature: Ductility at High Temperature (%) | Characteristics at High Temperature: Surface Properties | Crystal Grain Size After Super-Plastic-Forming (μm) |
|---|---|---|---|---|---|---|---|---|
| Invention's Example 1 | A1 | P1 | 405 | 60 | 0.35 | 286 | B | 8.3 |
| Invention's Example 2 | A2 | P1 | 342 | 64 | 0.45 | 253 | B | 9.2 |
| Invention's Example 3 | A3 | P1 | 443 | 69 | 0.25 | 291 | A | 7.7 |
| Invention's Example 4 | A6 | P1 | 385 | 52 | 0.35 | 274 | B | 8.0 |
| Invention's Example 5 | A8 | P1 | 452 | 312 | 0.25 | 312 | A | 6.6 |

TABLE 3-continued

| | Alloy Number | Conditions of Production | 0.2% Proof Stress (MPa) | Density of Intermetallic Compound Having Equivalent Circle Diameter of 5-15 μm (pieces/mm$^2$) | Frequency of KAM ≤ 15° | Characteristics at High Temperature: Ductility at High Temperature (%) | Characteristics at High Temperature: Surface Properties | Crystal Grain Size After Super-Plastic-Forming (μm) |
|---|---|---|---|---|---|---|---|---|
| Invention's Example 6 | A10 | P1 | 430 | 365 | 0.34 | 265 | A | 5.8 |
| Invention's Example 7 | A12 | P1 | 421 | 212 | 0.36 | 262 | B | 5.6 |
| Invention's Example 8 | A14 | P1 | 421 | 315 | 0.36 | 259 | B | 6.3 |
| Invention's Example 9 | A1 | P2 | 412 | 62 | 0.25 | 297 | A | 8.2 |
| Invention's Example 10 | A1 | P5 | 395 | 210 | 0.32 | 262 | A | 8.2 |
| Invention's Example 11 | A8 | P2 | 460 | 320 | 0.22 | 315 | A | 6.3 |
| Invention's Example 12 | A8 | P8 | 456 | 365 | 0.23 | 275 | A | 9.0 |
| Invention's Example 13 | A8 | P11 | 460 | 302 | 0.25 | 320 | A | 7.0 |
| Invention's Example 14 | A8 | P12 | 458 | 310 | 0.25 | 308 | A | 8.5 |
| Invention's Example 15 | A1 | P13 | 355 | 65 | 0.37 | 261 | B | 8.4 |
| Invention's Example 16 | A16 | P1 | 401 | 57 | 0.26 | 271 | A | 6.5 |
| Invention's Example 17 | A8 | P15 | 455 | 331 | 0.23 | 335 | A | 6.0 |
| Invention's Example 18 | A8 | P16 | 459 | 350 | 0.21 | 350 | A | 5.7 |
| Invention's Example 19 | A8 | P17 | 450 | 311 | 0.25 | 310 | A | 6.5 |
| Comparative Example 1 | A4 | P1 | 320 | 53 | 0.48 | 212 | B | 13.0 |
| Comparative Example 2 | A5 | P1 | — | — | — | — | — | — |
| Comparative Example 3 | A7 | P1 | 376 | 40 | 0.42 | 261 | D | 11.0 |
| Comparative Example 4 | A9 | P1 | 461 | 421 | 0.26 | 243 | A | 5.9 |
| Comparative Example 5 | A11 | P1 | 455 | 453 | 0.29 | 198 | A | 5.5 |
| Comparative Example 6 | A13 | P1 | 410 | 433 | 0.35 | 209 | B | 5.7 |
| Comparative Example 7 | A15 | P1 | 430 | 418 | 0.34 | 230 | B | 6.2 |
| Comparative Example 8 | A1 | P4 | 407 | 20 | 0.36 | 294 | D | 8.7 |
| Comparative Example 9 | A1 | P6 | 407 | 413 | 0.32 | 230 | A | 8.1 |
| Comparative Example 10 | A8 | P7 | 460 | 405 | 0.22 | 225 | A | 9.5 |
| Comparative Example 11 | A8 | P9 | 449 | 431 | 0.25 | 190 | A | 9.0 |
| Comparative Example 12 | A8 | P10 | 458 | 412 | 0.23 | 218 | A | 9.2 |
| Comparative Example 13 | A1 | P14 | 320 | 63 | 0.38 | 234 | B | 12.0 |
| Comparative Example 14 | A14 | P3 | 430 | 306 | 0.42 | 265 | D | 9.2 |

Examples 1 to 19 of the invention satisfied the structural requirements specified in claim 1, and thus the ductility at a high temperature and the characteristics at a high temperature of the surface properties were acceptable.

On the other hand, the Mg content of the aluminum alloy was too low in Comparative Example 1. As a result, the amount of strain introduced in the cold rolling step was low, and the crystal grains were not made fine enough. Thus, the ductility at a high temperature was unacceptable. The 0.2.% proof stress was also unacceptable.

The Mg content of the aluminum alloy was too high in Comparative Example 2. As a result, the plate was fractured during rolling, and evaluation was not possible.

The Mn content was too low in Comparative Example 3. As a result, the amount of the formed intermetallic compound having an equivalent circle diameter of 5 to 15 μm was too low, and the surface properties were unacceptable.

The Mn content was too high in Comparative Example 4. As a result, the amount of the formed intermetallic compound having an equivalent circle diameter of 5 to 15 μm was too high, and the occurrence of cavitation was promoted. Thus, the ductility at a high temperature was unacceptable.

The Cr content was too high in Comparative Example 5. As a result, the amount of the formed intermetallic compound having an equivalent circle diameter of 5 to 15 μm was too high, and the occurrence of cavitation was promoted. Thus, the ductility at a high temperature was unacceptable.

The Fe content was too high in Comparative Example 6. As a result, the amount of the formed intermetallic compound having an equivalent circle diameter of 5 to 15 μm was too high, and the occurrence of cavitation was promoted. Thus, the ductility at a high temperature was unacceptable.

The Si content was too high in Comparative Example 7. As a result, the amount of the formed intermetallic compound having an equivalent circle diameter of 5 to 15 μm was too high, and the occurrence of cavitation was promoted. Thus, the ductility at a high temperature was unacceptable.

The indicator of the cooling rate (t/L) was too small in Comparative Example 8. As a result, the formation of the intermetallic compound having an equivalent circle diameter of 5 to 15 μm was prevented, and the surface properties were unacceptable.

The indicator of the cooling rate (t/L) was too large in Comparative Example 9. As a result, the amount of the formed intermetallic compound having an equivalent circle diameter of 5 to 15 μm was too high, and the occurrence of cavitation was promoted. Thus, the ductility at a high temperature was unacceptable.

The homogenization temperature was too low in Comparative Example 10. As a result, the amount of the formed intermetallic compound having an equivalent circle diameter of 5 to 15 μm was too high, and the occurrence of cavitation was promoted. Thus, the ductility at a high temperature was unacceptable.

The homogenization temperature was too high in Comparative Example 11. As a result, the amount of the formed intermetallic compound having an equivalent circle diameter of 5 to 15 μm was too high due to the occurrence of eutectic melting, and the occurrence of cavitation was promoted. Thus, the ductility at a high temperature was unacceptable.

The homogenization period was too short in Comparative Example 12. As a result, the amount of the formed intermetallic compound having an equivalent circle diameter of 5 to 15 μm was too high, and the occurrence of cavitation was promoted. Thus, the ductility at a high temperature was unacceptable.

The final reduction ratio in cold rolling was too small in Comparative Example 13. As a result, the amount of strain introduced in the cold rolling step was low, and the crystal grains were not made fine enough. Thus, the ductility at a high temperature was unacceptable. The 0.2% proof stress was also unacceptable.

The reduction ratio in hot rolling was too small in Comparative Example 14. As a result, the region in which the strain was smaller than in the surrounding region was large, and the surface properties were unacceptable.

Second Example

Next, the second Example of the invention is explained. Samples were produced in a similar manner to that in the first Example except that ingots of alloys having the compositions shown in Table 4 were produced by the DC casting process. Then, the samples produced were evaluated in similar manners to those in the first Example. In the second Example, the corrosion resistance below was also evaluated in addition to the evaluation items of the first Example.

TABLE 4

| Alloy | Alloy Composition (mass %) | | | | | | | | | |
|---|---|---|---|---|---|---|---|---|---|---|
| Number | Mg | Mn | Cr | Fe | Si | Cu | Zn | Ti | Al | Remarks |
| A17 | 4.5 | 1.7 | 0.05 | 0.05 | 0.03 | 0.01 | 0.01 | 0.01 | balance | within the scope of the invention |
| A18 | 4.5 | 1.7 | 0.05 | 0.05 | 0.03 | 0.07 | 0.01 | 0.01 | balance | outside the scope of the invention |
| A19 | 4.5 | 1.7 | 0.05 | 0.05 | 0.03 | 0.01 | 0.06 | 0.01 | balance | outside the scope of the invention |

4-5. Evaluation of Corrosion Resistance

The final plate samples were heated at 500° C. for 10 minutes and then subjected to the CASS test for 500 hours based on JIS-H8502. As a result, the corrosion resistance according to CASS was determined to be acceptable (B) when corrosion perforation did not develop in the sample even after 500 hours or unacceptable (C) when corrosion perforation developed.

The results of the evaluation are shown in Table 5.

TABLE 5

| | Alloy Number | Conditions of Production | 0.2% Proof Stress (MPa) | Density of Intermetallic Compound: Having Equivalent Circle Diameter of 5-15 μm (pieces/mm$^2$) | Frequency of KAM ≤ 15° | Characteristics at High Temperature: Ductility at High Temperature (%) | Characteristics at High Temperature: Surface Properties | Crystal Grain: Size After Superplastic-Forming (μm) | Corrosion Resistance |
|---|---|---|---|---|---|---|---|---|---|
| Invention's Example 20 | A17 | P1 | 452 | 312 | 0.25 | 312 | A | 6.6 | B |
| Comparative Example 15 | A18 | P1 | 451 | 320 | 0.25 | 310 | A | 6.7 | C |
| Comparative Example 16 | A19 | P1 | 450 | 322 | 0.24 | 301 | A | 6.4 | C |

Example 20 of the invention satisfied the structural requirements specified in claim 2, and thus the ductility at a high temperature, the characteristics at a high temperature of the surface properties and the corrosion resistance were acceptable.

On the other hand, the Cu content of the aluminum alloy was too high in Comparative Example 15. As a result, the corrosion resistance was unacceptable.

The Zn content of the aluminum alloy was too high in Comparative Example 16. As a result, the corrosion resistance was unacceptable.

INDUSTRIAL APPLICABILITY

According to the invention, a superplastic-forming aluminum alloy plate having excellent superplastic-forming properties, excellent surface properties after forming and corrosion resistance is provided.

The invention claimed is:

1. A superplastic-forming aluminum alloy plate comprising an aluminum alloy containing 2.0 to 6.0 mass % Mg, 1.2 to 1.4 mass % Mn, 0.001 to 0.05 mass % Cr and a balance of Al and unavoidable impurities, wherein the unavoidable impurities are restricted to have 0.20 mass % or less Fe and 0.20 mass % or less Si, the 0.2% proof stress is 340 MPa or more and the density of intermetallic compounds having an equivalent circle diameter of 5 to 15 μm at the RD-TD plane which extends along the center of the plate cross-section is 50 to 400 pieces/mm$^2$, and a frequency of Kernel Average Misorientation of 15° or less at the RD-TD plane which extends along the center of the plate cross-section is 0.34 or less.

2. The superplastic-forming aluminum alloy plate according to claim 1, wherein the unavoidable impurities are further restricted to have at least one selected from 0.05 mass % or less Cu and 0.05 mass % or less Zn.

3. The superplastic-forming aluminum alloy plate according to claim 1, wherein a crystal grain size after superplastic-forming at the RD-TD plane which extends along the center of the plate cross-section is 10 μm or less.

4. The superplastic-forming aluminum alloy plate according to claim 1, which is an aluminum alloy plate for blow molding.

5. A method for producing the superplastic-forming aluminum alloy plate according to claim 1, comprising:

a casting step for semi-continuous casting a molten metal of the aluminum alloy in which $1000 \leq t/L \leq 4000$ is satisfied, where t is the thickness of an ingot (mm) and L is an amount of cooling water per unit time and unit ingot length (liter/minute·mm), a homogenization step for heat treating the obtained ingot at 400 to 560° C. for 0.5 hours or longer, a hot rolling step for hot rolling the homogenized ingot in which the reduction ratio at a temperature of 250 to 350° C. in the last 1 pass is 30% or more, and a cold rolling step for cold rolling the hot-rolled plate with a final reduction ratio in cold rolling of 50% or more.

6. The method for producing the superplastic-forming aluminum alloy plate according to claim 5, further comprising:

One or, two or more process annealing steps for annealing the rolled plate at 300 to 400° C. for one to four hours before or during the cold rolling step or before and during the cold rolling step.

* * * * *